US011613387B2

(12) United States Patent
Brizzi

(10) Patent No.: US 11,613,387 B2
(45) Date of Patent: Mar. 28, 2023

(54) VIBRATING DEVICE FOR THE ORDERLY REARRANGEMENT OF FOLDING BOXES IN A CONTAINER, DISCHARGING CONVEYOR AND METHOD FOR DISCHARGING CONTAINERS

(71) Applicant: BOBST MEX SA, Mex (CH)

(72) Inventor: Nicolas Brizzi, Martigny (CH)

(73) Assignee: BOBST MEX SA, Mex (CH)

( * ) Notice: Subject to any disclaimer, the term of this patent is extended or adjusted under 35 U.S.C. 154(b) by 1064 days.

(21) Appl. No.: 16/303,949

(22) PCT Filed: May 15, 2017

(86) PCT No.: PCT/EP2017/025126
§ 371 (c)(1),
(2) Date: Nov. 21, 2018

(87) PCT Pub. No.: WO2017/202499
PCT Pub. Date: Nov. 30, 2017

(65) Prior Publication Data

US 2020/0317376 A1 Oct. 8, 2020

(30) Foreign Application Priority Data

May 25, 2016 (EP) ..... 16020187

(51) Int. Cl.
*B65B 1/22* (2006.01)
*B65B 25/14* (2006.01)
(Continued)

(52) U.S. Cl.
CPC ..... *B65B 1/22* (2013.01); *B01F 31/24* (2022.01); *B65B 25/143* (2013.01);
(Continued)

(58) Field of Classification Search
CPC ..... B65B 1/22; B65B 25/143; B65B 25/145; B65B 43/52; B65B 43/54
See application file for complete search history.

(56) References Cited

U.S. PATENT DOCUMENTS 2,455,664 A * 12/1948 Ferguson et al. ..... E21D 15/54 411/902
2,620,011 A * 12/1952 Zinke ..... B21D 1/10 254/133 R
(Continued)

FOREIGN PATENT DOCUMENTS

CH 659627 2/1987
CN 2734694 Y 10/2005
(Continued)

OTHER PUBLICATIONS

International Search Report issued in related PCT/EP2017/025126 (dated Jun. 14, 2017) (3 pages).

*Primary Examiner* — Andrew M Tecco
(74) *Attorney, Agent, or Firm* — Bookoff McAndrews, PLLC

(57) ABSTRACT

A vibrating device (14) ensures the ordered rearrangement of folding boxes (3) in a receptacle (2) for an evacuation conveyor (8), provided with driving elements (12) whose vertices define a horizontal transport plane (S2). The device comprises:

a movable support (15) able to support a receptacle (2) loaded with folding boxes (3), the support (15) having a contact surface (S1) designed to be in contact with the receptacle (2), and at least one controllable actuator (16*a*, 16*b*, 16*c*, 16*d*) comprising a displaceable end connected to the support (15) and able to displace the support (15) between:
(Continued)

a retracted position in which the contact surface (S1) is positioned beneath the horizontal transport plane (S2), allowing a contact between the receptacle (2) and the driving elements (12), and a deployed position in which the contact surface (S1) is positioned above the horizontal transport plane (S2), preventing the contact between the receptacle (2) and the driving elements (12), the actuator (16*a*, 16*b*, 16*c*, 16*d*) being likewise designed to cause the support (15) to vibrate about the deployed position in order to reorder the disposition of the folding boxes (3) contained in the receptacle (2).

18 Claims, 6 Drawing Sheets

(51) Int. Cl.

| | |
|---|---|
| ***B65B 43/52*** | (2006.01) |
| ***B65B 43/54*** | (2006.01) |
| ***B65B 61/28*** | (2006.01) |
| ***B65B 65/00*** | (2006.01) |
| ***B01F 31/24*** | (2022.01) |

(52) U.S. Cl.
CPC ..... *B65B 25/145* (2013.01); *B65B 43/52* (2013.01); *B65B 43/54* (2013.01); *B65B 61/28* (2013.01); *B65B 65/003* (2013.01)

(56) References Cited

U.S. PATENT DOCUMENTS

| | | | | | |
|---|---|---|---|---|---|
| 2,712,406 | A | * | 7/1955 | Kindseth | B65B 1/22 141/180 |
| 4,656,815 | A | | 4/1987 | Jaton | |
| 4,782,865 | A | * | 11/1988 | Everman | B65B 1/32 141/168 |
| 5,238,032 | A | * | 8/1993 | McGregor | B65B 1/22 141/73 |
| 5,400,837 | A | * | 3/1995 | Kelley | B65B 43/60 141/10 |
| 5,894,712 | A | * | 4/1999 | Segers | B65B 1/22 53/525 |
| 2006/0092756 | A1 | | 5/2006 | Lindbeck | |
| 2008/0192565 | A1 | | 8/2008 | Johnson | |

FOREIGN PATENT DOCUMENTS

| | | | | | |
|---|---|---|---|---|---|
| CN | 201030947 | Y | | 3/2008 | |
| CN | 201291109 | Y | | 8/2009 | |
| CN | 201457745 | U | | 5/2010 | |
| CN | 202896897 | U | | 4/2013 | |
| CN | 103648930 | A | | 3/2014 | |
| CN | 204211042 | U | | 3/2015 | |
| GB | 874 977 | A | | 8/1961 | |
| JP | S6423903 | A | | 1/1989 | |
| JP | H01 182211 | A | | 7/1989 | |
| JP | H08-001169 | U | | 7/1996 | |
| JP | 2001-114225 | A | | 4/2001 | |
| WO | WO 95/18043 | | | 7/1995 | |
| WO | WO 2005/110850 | | | 11/2005 | |
| WO | WO-2005110850 | A1 | * | 11/2005 | B65B 1/06 |

* cited by examiner

VIBRATING DEVICE FOR THE ORDERLY REARRANGEMENT OF FOLDING BOXES IN A CONTAINER, DISCHARGING CONVEYOR AND METHOD FOR DISCHARGING CONTAINERS

CROSS-REFERENCE TO RELATED APPLICATION(S)

This application is a National Stage under 35 U.S.C. § 371 of International Application No. PCT/EP2017/025126, filed on May 15, 2017, which claims priority to European Patent Application No. 16020187.7, filed on May 25, 2016, the contents of all of which are incorporated by reference in their entirety.

The present invention relates to a vibrating device for the ordered rearrangement of folding boxes in a receptacle for an evacuation conveyor, the folding boxes being prepared in particular by a folder-gluer machine. The present invention likewise relates to an evacuation conveyor of receptacles loaded with folding boxes, as well as a conveyor of receptacles and a method of evacuation of receptacles.

Folder-gluer machines glue and fold flat the folding boxes which will contain products such as blister packs for drugs or other products, for example those packaged by a third-party industry. The boxes folded flat may then be stored effectively in intermediate receptacles (such as cartons) for delivery to manufacturers.

Document CH 659627 describes an example of a device for filling receptacles with folding boxes coming from a folder-gluer machine. The folded boxes are then placed in a sheet and delivered by a box conveyor to a receptacle. Each receptacle may contain a significant number of folded boxes, such as several dozens or hundreds of boxes.

However, it may happen that the folded boxes are received wrong in the receptacle, for example, they are clinging together by friction, static electricity, or being stuck on the edge of another box.

In production, a worker is generally assigned to watch over the proper filling of the folded boxes in the receptacle. If he or she finds a wrong positioning, the worker will manually shake the receptacle in order to reorganize the arrangement of the folding boxes.

However, this intervention cannot be systematic. In fact, the worker cannot shake all the receptacles due to the very high tempo of production. A folder-gluer machine can supply a filling station at a tempo of 200000 boxes an hour. Moreover, this operation is tiresome to the worker, due to the repetitive nature of the task. Likewise, the shaking force applied by the worker may be variable. The reproducibility of the arrangement of the folding boxes in the receptacles is thus not guaranteed, since it depends on the assessment of the worker and his or her vigilance.

SUMMARY OF THE INVENTION

One of the goals of the present invention is to propose a vibrating device for the ordered rearrangement of folding boxes in a receptacle and a method of conveying of receptacles able to solve at least in part the aforementioned drawbacks.

For this purpose, the present invention relates to a vibrating device for the ordered rearrangement of folding boxes in a receptacle for an evacuation conveyor provided with driving elements whose vertices define a horizontal transport plane, characterized in that it comprises:

a movable support able to support a receptacle loaded with folding boxes, the support having a contact surface designed to be in contact with the receptacle, and at least one controllable actuator comprising a displaceable end connected to the support and able to displace the support between:

a retracted position in which the contact surface is positioned beneath the horizontal transport plane, allowing a contact between the receptacle and the driving elements, and a deployed position in which the contact surface is positioned above the horizontal transport plane, preventing the contact between the receptacle and the driving elements, the actuator being likewise designed to cause the support to vibrate about the deployed position in order to reorder the disposition of the folding boxes contained in the receptacle.

Causing the receptacle loaded with folding boxes to vibrate makes it possible to reposition the folding boxes in an ordered manner, by successive sliding of the boxes with respect to each other, so that they rest entirely on edge, on the bottom of the receptacle. A vibrating device is obtained for the ordered rearrangement of folding boxes in the receptacles, which can be automated and realized for each receptacle in a reproducible manner and at very high tempo, which would not be possible manually. Moreover, the operation of the actuators can be controlled by programmed sequences which can be adapted in particular to optimize the arrangement according to the shape of the folding boxes filling up the receptacle.

According to one or more characteristics of the vibrating device:

the vibrating device comprises a control unit connected to the actuator, the control unit being designed to control the travel of the actuator between the retracted position and the deployed position and to cause the support to vibrate in the deployed position, the control unit is designed to be connected to the driving elements of the evacuation conveyor, to control the stopping of the driving elements prior to control the displacement of the support into the deployed position, and to control the restarting of the driving elements after the displacement of the support into the retracted position, the vibrating device comprises at least two actuators connected to the support and arranged at a spacing from each other, the control unit being designed to control the two actuators sequentially in a predetermined operating sequence, the support comprises at least two support elements, each having a blade and a support plate, the support plate being secured perpendicular to the blade, the blades being disposed in parallel in the same plane, the support elements being situated between two driving elements of the evacuation conveyor, the vibrating device comprises at least one shock absorber situated between the actuator and the support, the actuator comprises a jack.

The invention also relates to an evacuation conveyor for the evacuation of receptacles loaded with folding boxes, characterized in that it comprises a vibrating device having one or more technical characteristics as described and claimed below.

The evacuation conveyor may comprise:

a positioning sensor designed to detect a positioning of a receptacle on the support, a movable end stop, controllable by the positioning sensor, able to be displaced between a retracted position and a blocking position.

The driving elements may comprise drive rollers.

The invention also relates to a conveyor of receptacles, comprising a routing conveyor to direct empty receptacles toward a filling zone of the conveyor, and comprising an evacuation conveyor for the evacuation of receptacles loaded with folding boxes having one or more technical characteristics as described and claimed below.

The invention likewise relates to a filling station, comprising a conveyor of receptacles having one or more technical characteristics as described and claimed below.

The invention further relates to a method of evacuation of receptacles from a filling zone, involving the successive steps:

ordering the advancement of an end stop when the arrival of a receptacle loaded with folding boxes is detected;

ordering the displacement of a support of a vibrating device from a retracted starting position, beneath a horizontal transport plane defined by the vertices of driving elements of the evacuation conveyor, to a deployed arrival position, above the horizontal transport plane, when the receptacle is situated against the end stop;

causing the support to vibrate in the deployed position so as to reorder the disposition of the folding boxes contained in the receptacle;

ordering the displacement of the support from the deployed position to the retracted position; and ordering a return of the end stop in order to allow the departure of the receptacle.

In this way, it is not necessary to halt the driving elements, since the receptacle is raised prior to being subjected to the vibrations. Thus, the other receptacles on the line are not halted.

SUMMARY DESCRIPTION OF THE DRAWINGS

Other advantages and characteristics will emerge upon reading the specification of the invention, as well as from the enclosed figures representing an exemplary nonlimiting embodiment of the invention in which.

Figure 1:
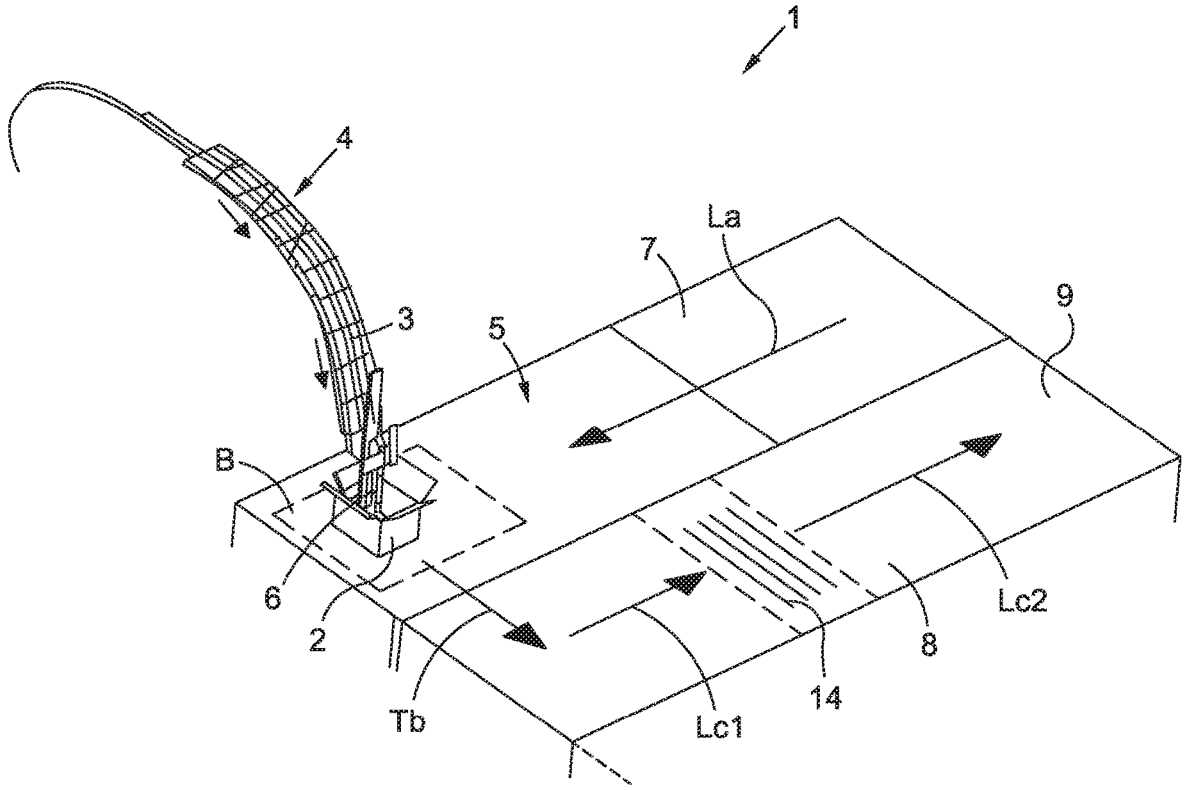
FIG. 1 shows a box transporter-filler and elements of a conveyor of receptacles of a filling station, more particularly, a conveyor for routing of empty receptacles to a filling zone and a first exemplary embodiment of an evacuation conveyor to evacuate the receptacles loaded with folding boxes.
Figure 4:
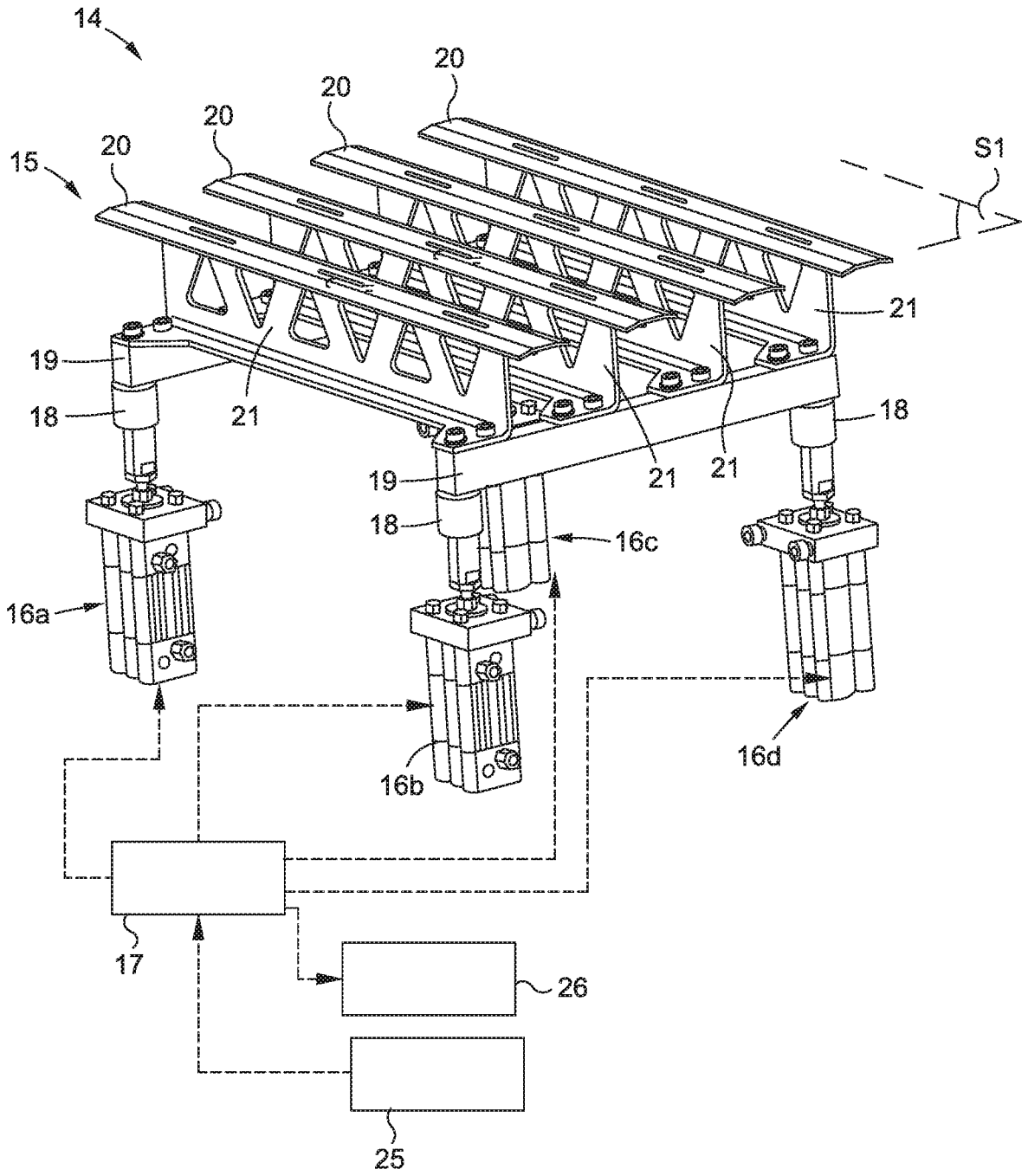
FIG. 4 shows a perspective view of a vibrating device of the evacuation conveyor of FIG. 3 as well as other elements of the evacuation conveyor, shown schematically.
Figure 5A:
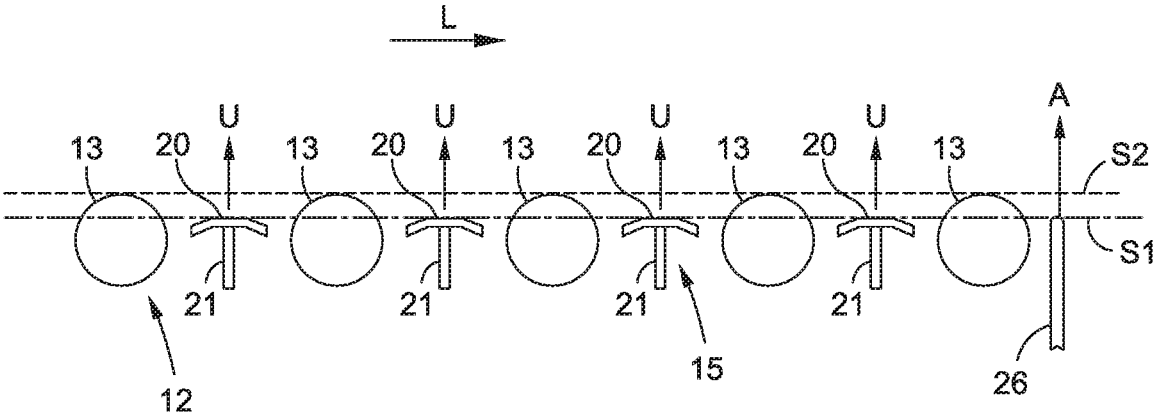
Figure 5B:
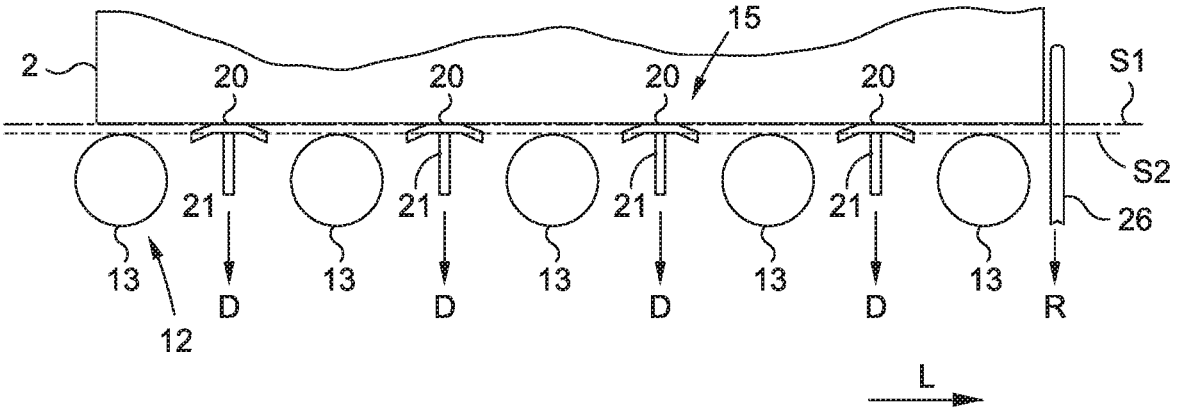
Figure 6:
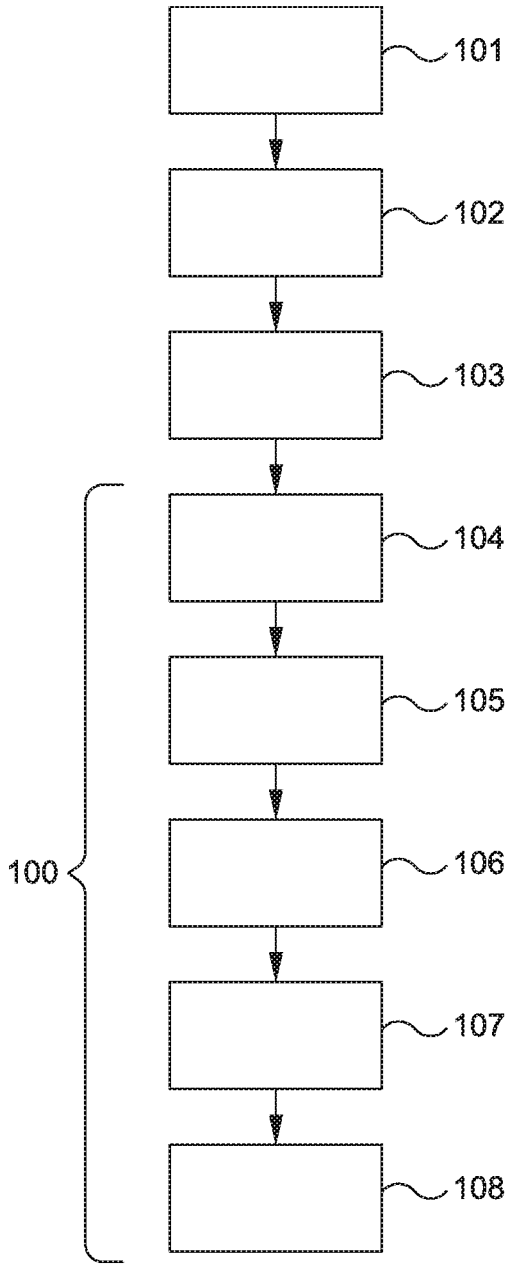
Figure 7:
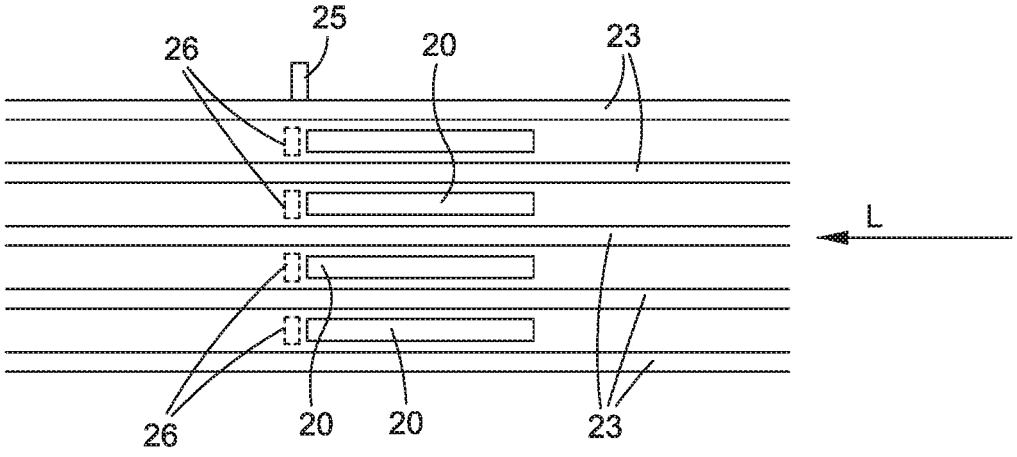
Figure 8:
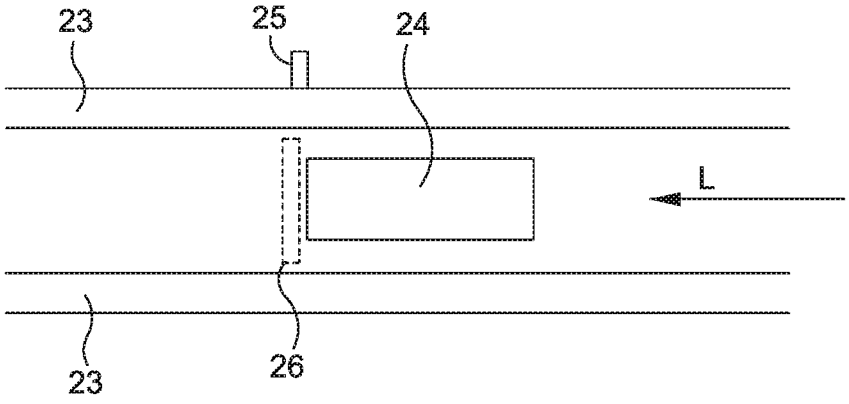

FIG. 5*a* shows schematically a partial longitudinal section view of the driving elements of the evacuation conveyor and the elements of the support of the vibrating device of FIG. 4 with the support in retracted position;

FIG. 5*b* is a view similar to FIG. 5*a* with the support in deployed position;

FIG. 6 shows a flow chart of the different steps of a method for routing, filling, and evacuation of receptacles by means of the conveyor of receptacles of FIG. 1; and FIGS. 7 and 8 show respectively a second and a third exemplary embodiment of the evacuation conveyor.

In these figures, identical elements carry the same reference numbers. The following embodiments are examples. Even though the description pertains to one or more embodiments, this does not necessarily mean that each reference involves the same embodiment, or that the characteristics apply only to a single embodiment. Single characteristics of different embodiments may likewise be combined or interchanged to provide other embodiments.

The directions longitudinal and transverse are defined by reference to the trajectory of the receptacles in the conveyor, along its middle longitudinal axis. The directions upstream and downstream are defined with reference to the direction of displacement along the trajectory of the receptacles.

EXEMPLARY EMBODIMENTS OF THE INVENTION

FIG. 1 shows a general view of the elements of a station 1 for filling of receptacles 2 in the form of cartons, the station 1 being possibly placed at the exit of a folder-gluer machine, for the filling of receptacles 2 with folding boxes 3.

The folding boxes 3 may be prepared by a folder-gluer machine which glues and folds the boxes 3 flat, which can then be stockpiled, in the folded and glued state, with a slight footprint in receptacles 2 for the purpose of being transported. The term "folding box" here denotes the folding boxes folded flat in order to be arranged in a receptacle 2.

Figure 2:
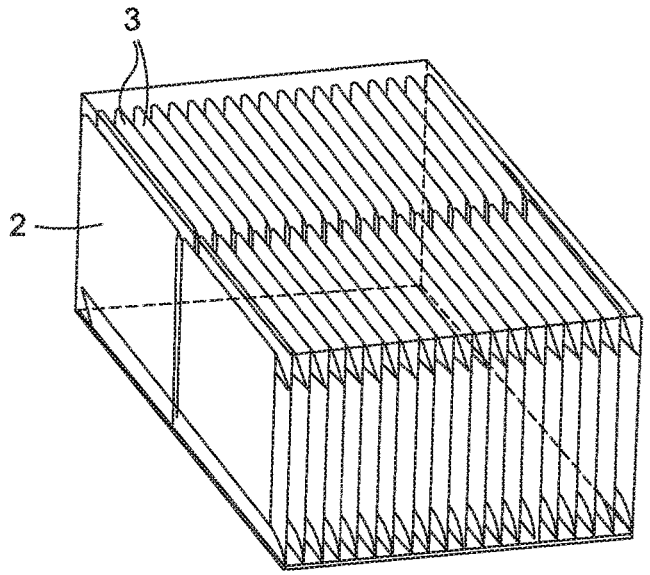
FIG. 2 shows schematically an example of a receptacle whose side walls are shown as being transparent, the receptacle being loaded with folding boxes arranged in an ordered manner.

The receptacle 2 is a box able to hold a plurality of folding boxes 3. For example, the receptacle 2 is made of cardboard. A receptacle 2 filled with two rows of folding boxes 3 positioned on the edge is shown as an illustration in FIG. 2.

As is shown by FIG. 1, the filling station 1 comprises a box transporter-filler 4 designed to grasp the folding boxes 3, for example placed in a sheet at the exit of the folder-gluer machine, and to transfer them to a filling zone B of a conveyor of receptacles 5. In the filling zone B, the folding boxes 3 having followed a substantially arch-shaped trajectory are disposed in ordered manner in a receptacle 2 by means of the movable end 6 of the box transporter-filler 4. The folding boxes 3 are then generally disposed in several rows of boxes alongside one another, more or less straightened out vertically.

The conveyor of receptacles 5 comprises a routing conveyor 7 for the receptacles 2, a transfer device for the receptacles 2 and an evacuation conveyor 8 for the receptacles 2.

The routing conveyor 7 directs the empty receptacles 2 to the filling zone B along a routing path La which is substantially a straight line. The evacuation conveyor 8 evacuates the receptacles 2 loaded with folding boxes 3 toward an exit 9 along an evacuation path Lc1, Lc2 which is substantially a straight line, parallel with the routing path La but opposite in direction. The transfer device moves the receptacle 2 loaded with folding boxes 3 from the filling zone B to the evacuation conveyor 8 (arrow Tb).

Figure 3:
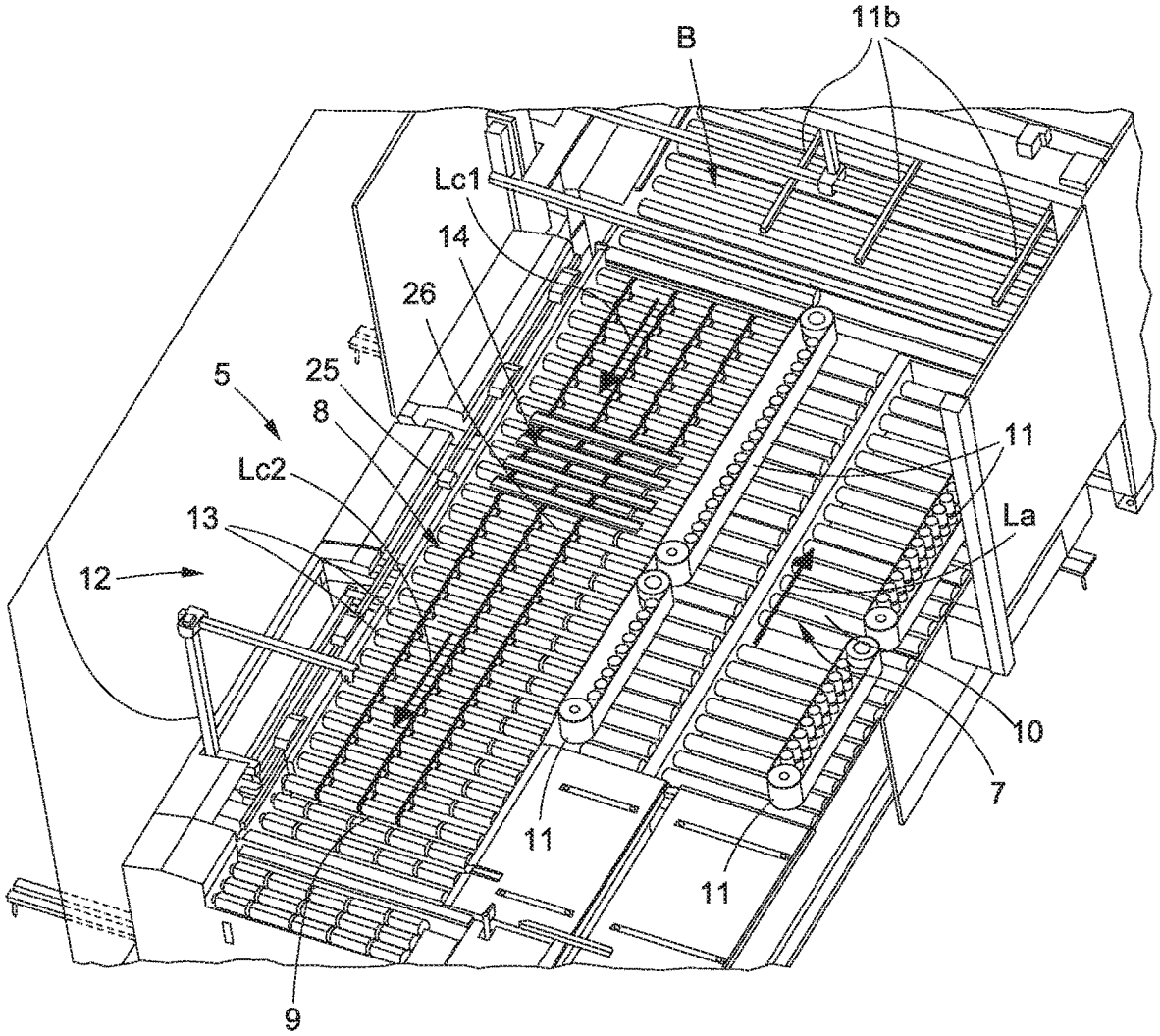
FIG. 3 shows a substantially top view of the evacuation conveyor of FIG. 1.

According to an exemplary embodiment best seen in FIG. 3, the routing conveyor 7 able to direct the empty receptacles 2 to the filling zone B comprises a train of free rollers 10. The principal direction of the rollers 10 extends in the transverse direction T. The rollers 10 are mounted idle, parallel to each other, in a horizontal plane along the routing path La. The routing conveyor 7 further comprises a lateral driving device designed to drive the empty receptacles 2 longitudinally by clamping the base of their opposite side walls. For this, the lateral driving device comprises for example at least one pair of belts 11, arranged symmetrically on either side of the train of free rollers 10, the driving bands of the belts 11 facing each other. In operation, the empty receptacles 2 are routed along the train of rollers 10, driven and guided laterally by the belts 11. This routing conveyor 7 is able to transport the empty and open receptacles 2 without deforming them.

The receptacle 2 loaded with folding boxes 3 is moved from the filling zone B to the evacuation conveyor 8 (arrow Tb), for example by means of a push system equipped with bars 11*b*.

The evacuation conveyor 8, designed to evacuate the receptacles 2 loaded with folding boxes 3 along the evacuation path Lc1, Lc2, comprises driving elements 12.

According to a first exemplary embodiment seen in FIG. 3, the driving elements 12 comprise drive rollers 13, mounted between two side jaws of the conveyor of receptacles 5. The drive rollers 13 are driven for example by means of belts (not visible). The principal direction of each roller 13 extends in the transverse direction T. The rollers 13 are arranged alongside each other, in parallel in a horizontal plane, in particular at the same height as the first train of free rollers 10, along the evacuation trajectory Lc1, Lc2.

The evacuation conveyor 8 further comprises a vibrating device 14 to improve the arrangement of the folding boxes 3 in the receptacle 2 on the evacuation path Lc1, Lc2.

Best seen in FIG. 4, the vibrating device 14 comprises a support 15 able to support a receptacle 2 loaded with folding boxes 3, the support 15 having a surface defining a plane of contact S1 designed to make contact with the receptacle 2, and at least one controllable actuator, in this example four actuators 16*a*, 16*b*, 16*c*, 16*d*, having an end able to move in linear manner in the vertical direction, connected to the support 15, in order to displace the support 15 between a retracted position (FIG. 5*a*) and a deployed position (FIG. 5*b*), and vice versa (arrows U and D).

In the retracted position, the contact surface S1 is positioned away from a horizontal transport plane S2 defined by the vertices of the driving elements 12 (FIG. 5*a*). In this position, the driving elements 12 support the receptacle 2 and can deliver it along the evacuation path Lc1, Lc2.

In the deployed position (FIG. 5*b*), the actuator raises the support 15 so that the contact surface S1 is positioned above the horizontal transport plane S2. In moving above the horizontal transport plane S2, the contact surface S1 supports the receptacle 2 in place of the driving elements 12, preventing the contact between the receptacle 2 and the driving elements 12.

The actuators 16*a*, 16*b*, 16*c*, 16*d* are likewise designed to cause the support 15 to vibrate about the deployed position in order to reorder the disposition of the folding boxes 3 contained in the receptacle 2. The vibrations are produced by reciprocating movements of low amplitude and high frequency about the deployment travel of the support 15 in the deployed position. The amplitude of the variations is less than or equal to the deployment travel.

Causing the receptacle 2 loaded with folding boxes 3 to vibrate makes it possible to reposition the folding boxes 3 in an ordered manner, by successive sliding of the boxes 3 with respect to each other, so that their lower edges rest on the bottom of the receptacle 2.

The vibrating device 14 may comprise a control unit 17 connected to the controllable actuators 16*a*, 16*b*, 16*c*, 16*d*, such as a computer, a controller or a microcontroller, comprising memory and programs to execute a series of instructions (FIG. 4).

The control unit 17 in particular is designed to control the deployment travel of the actuators 16*a*, 16*b*, 16*c*, 16*d* so as to displace U the support 15 between the retracted position and the deployed position and to control the small reciprocating movements at high frequency in order to cause the vibrating of the support 15 about the deployed position. As an example, a frequency range between 2 Hz and 50 Hz may be chosen to cause effective vibration of the receptacle 2, depending on the dimensions of the receptacle 2 and the boxes 3 placed inside the receptacle 2.

The deployment travel of the actuator 16*a*, 16*b*, 16*c*, 16*d*, allowing the support 15 to be deployed U from the retracted position to the deployed position beyond the driving elements 12, is relatively large, such as more than 1 cm. The variations in amplitudes of vibration about this deployment travel are much smaller. For example, they are less than 1 mm.

The actuator 16*a*, 16*b*, 16*c*, 16*d* comprises, for example, a pneumatic jack, with electrical control, having a movable rod whose end is connected to the support 15. The use of jacks is advantageous, since it is not very costly. Furthermore, jacks are easy to implement and their electronic control is simple and flexible and it allows a precise displacement, both for the large deployment travel of the support 15 and for the minor variations in amplitudes at high frequency about this deployment travel, to cause the support 15 to vibrate.

The vibrating device 14 may comprise, for example, at least two actuators 16*a*, 16*b*, 16*c*, 16*d* connected to the support 15, arranged at a spacing from each other. In the example illustrated in FIG. 4, the vibrating device 14 thus comprises four actuators 16. The movable ends of the actuators 16*a*, 16*b*, 16*c*, 16*d* are connected for example to the respective ends of two beams 19 of the support 15, arranged in parallel. A plurality of actuators 16*a*, 16*b*, 16*c*, 16*d* makes it possible for example to provide inclination movements to the lifted receptacle 2 by ordering different travel paths for at least two actuators 16*a*, 16*b*, 16*c*, 16*d* at the same time or by controlling the actuators 16*a*, 16*b*, 16*c*, 16*d* sequentially in a predetermined operating sequence, for example by commanding a larger deployment travel for a single actuator 16*a*, 16*b*, 16*c*, 16*d* at a time, and then repeating this command in turn for each actuator 16*a*, 16*b*, 16*c*, 16*d*.

As an example of a command sequence for the jacks making it possible to achieve a good arrangement, the actuators are raised and then the actuators cause vibrations for 2 seconds at 10 Hz, then they are lowered once more. The size of the box, the type of carton, and the imprinting, if any, are the parameters taken into account for regulating the vibrations.

The ends of the actuators 16*a*, 16*b*, 16*c*, 16*d* are connected to the support 15 directly or indirectly via shock absorbers 18. In fact, shock absorbers 18 may be installed between the end of each actuator 16*a*, 16*b*, 16*c*, 16*d* and the support 15 to avoid transmitting the vibrations from the support 15 to the frame. The shock absorbers 18 are, for example, blocks of flexible material, such as rubber blocks.

To halt the advancement of the receptacle 2 and to allow the control unit 17 to command the stopping of the driving elements 12, the evacuation conveyor 8 may comprise a positioning sensor 25 and a movable end stop 26, controllable by the positioning sensor 25, to be displaced between a retracted return position and an advanced blocking position (arrow A in FIG. 5*a*), and vice versa (arrow R in FIG. 5*b*).

The positioning sensor, such as an electric cell 25, is designed to detect the positioning of a receptacle 2 upstream from the end stop 26, when the receptacle 2 is positioned above the support 15, then removed in the retracted position. The positioning sensor 25 for example is designed to detect the arrival of a front wall of the receptacle 2 in the area of one downstream end of the support 15. This is for example an optical sensor able to detect the crossing of a transverse light beam situated downstream from the support 15.

The end stop 26 is disposed downstream from the vibrating device 14 in the direction of displacement of the receptacles 2 along the evacuation path Lc1, Lc2 from the filling zone B to the exit 9. The end stop 26, such as a cleat, slides between a retracted position (FIG. 5*a*) and a blocking position (FIG. 5*b*) in which the receptacle 2 comes up against the end stop 26. The advantage of the end stop 26 is to not interrupt the driving of the various empty and filled receptacles, making the filling station 1 operate non-stop.

The displacement of the end stop 26 is controllable by the positioning sensor 25 which moves the end stop 26 into the blocking position A when a receptacle 2 is detected above the support 15 and into the retracted position R to free up the passage for the receptacle 2 after the rearrangement of the folding boxes 3. The control can be realized directly, for example by means of an electrical contact, or indirectly by means of a control such as the control unit 17.

One exemplary embodiment of the support 15 shall be described with reference to FIG. 4 and to FIGS. 5*a* and 5*b*. The support 15 comprises at least two support elements each one having a blade 20 and a support plate 21, installed between two driving elements 12 of the evacuation conveyor 8 in the longitudinal direction of the evacuation trajectory Lc1, Lc2.

The support plate 21 is secured substantially perpendicular to the blade 20, on a lower face of the blade 20, for example in centered manner, the transverse section of a support element having a general T shape. This T shape allows the support plates 21 to be easily inserted vertically between two drive rollers 13, while being able to move vertically between them.

The blades 20 have, for example, a substantially flat upper surface. The front and rear edges of each blade 20 with regard to the direction of displacement of the receptacle 2 on the evacuation trajectory Lc1, Lc2 may be considerably inclined downward to prevent them from catching on the receptacle 2.

The blades 20 are disposed parallel to each other, the upper plane of the blades 20 forming the contact surface S1 designed to receive the receptacle 2 loaded with folding boxes 3 (represented by mixed lines in FIGS. 5*a* and 5*b*). This plane is horizontal when the vibrating device 14 is raised in the evacuation conveyor 8.

One will provide for example four support elements 20, 21 regularly spaced apart from each other, the contact surface S1 being inscribed in a rectangular shape. The two beams 19 of the support 14 connect the lower ends of the support plates 21 to the movable ends of the actuators 16*a*, 16*b*, 16*c*, 16*d*.

In the example illustrated, the principal direction of the blades 20 extends in the transverse direction T, parallel to the principal direction of the drive rollers 13.

The positioning sensor 25 is arranged for example so as to detect the passage of the receptacle 2 in the area of the edge of the last blade 20 of the support 15, in the direction of displacement toward the exit 9.

FIG. 6 illustrates the method with the different steps of routing of the empty receptacles 2 toward the filling zone B, the filling of the receptacles 2 and the evacuation of the receptacles 100 loaded with folding boxes 3.

In a first step 101, the routing conveyor 7 transports empty and open receptacles 2 on the first roll train 10, along the routing path La up to the filling zone B.

Once arrived at the filling zone B, and in a second step 102, the receptacle 2 receives folding boxes 3 which have been routed by the box transporter-filler 4. These boxes are disposed more or less vertically straightened out in the receptacle 2 in more or less ordered fashion.

In a third step 103, once the receptacle 2 has been filled with folding boxes 3, the receptacle 2 is displaced from the filling zone B to the evacuation conveyor 8 by the push system 11*b* (arrow Tb; FIGS. 1 and 3).

The receptacle 2 is then driven on the evacuation path Lc1, Lc2 by the driving elements 12 of the evacuation conveyor 8. The evacuation path Lc1, Lc2 is broken down into two parts. In a first part Lc1, the receptacle 2 is driven up to the vibrating device 14. The support 15 of the device 14 is then in the retracted position (FIG. 5*a*). In this position, the contact surface S1 is situated below the horizontal transport plane S2 of the driving elements 12. The driving elements 12 in contact with the receptacle 2 drive it above the support 15.

When the positioning sensor 25 detects the front wall of a receptacle 2 downstream from the support 15, and in a fourth step 104, the end stop 26 is displaced and advances A into the blocking position and blocks the receptacle 2, which is centered above the support 15 (FIG. 5*b*).

Next, the control unit 17 commands the displacement of the support 15 from the retracted position to the deployed position (FIG. 5*b*; fifth step 105). In the deployed position, the contact surface S1 rises above the horizontal transport plane S2 of the driving elements 12, raising the receptacle 2 loaded with folding boxes 3.

The control unit 17 then commands the vibration of the support 15 to reorder the disposition of the folding boxes 3 in the receptacle 2 (sixth step 106). It is likewise possible to command different travels for the actuators 16*a*, 16*b*, 16*c*, 16*d*, for example, to impart inclination movements to the lifted receptacle 2.

Next, the control unit 17 commands the displacement of the support 15 into the retracted position (seventh step 107). The contact surface S1 thus goes once more beneath the horizontal transport plane S2 of the driving elements 12.

In an eighth step 108, the control unit 17 then commands the return and the displacement R of the end stop 26 into the retracted position, freeing up the passage for the receptacle 2.

The receptacle 2 loaded with properly ordered folding boxes 3 is then driven on the second part of the evacuation path Lc2 toward the exit 9 where it can be evacuated.

One thus has a vibrating device 14 for the ordered rearrangement of folding boxes 3 in receptacles 2 which can be automated, realized for each receptacle 2 in reproducible manner and at very high cadence, which was not possible manually. Moreover, the operating of the actuators 16*a*, 16*b*, 16*c*, 16*d* can be controlled by programmed sequences which can be adapted in particular to optimize the arrangement according to the shape of the folding boxes 3 filling the receptacle 2.

Other embodiments may be contemplated for the support 15 and for the driving elements 12, especially as represented schematically in FIGS. 7 and 8.

In the example of FIG. 7, the driving elements 12 comprise belts whose driving bands extend horizontally along the evacuation path Lc1, Lc2, in the longitudinal direction L of the evacuation conveyor 8.

The evacuation conveyor 8 comprises for example at least three driving belts 23, such as four belts, arranged alongside one another in parallel in the longitudinal direction L. The support 15, as previously, may comprise at least two support elements each one having a blade 20 and a support plate 21, secured perpendicularly to the blade 20. As previously, the blades 20 are disposed parallel to each other, the upper plane of the blades 20 forming the contact surface S1.

In this example, each support element is likewise installed between two drive belts 23 of the evacuation conveyor 8. This example likewise differs from the previous one by the fact that the principal direction of the blades 20 extends in the longitudinal direction L of the evacuation path Lc1, Lc2, parallel to the principal direction of the drive belts 23.

According to one variant embodiment, represented schematically in FIG. 8, the evacuation conveyor 8 comprises only two drive belts 23 arranged on either side of the support 24. The support 24, now central, may be realized by a single plate whose lower face is connected to the actuators 16*a*, 16*b*, 16*c*, 16*d*.

The invention claimed is:

1. A vibrating device for the ordered rearrangement of folding boxes in a receptacle for an evacuation conveyor, provided with driving elements whose vertices define a horizontal transport plane, wherein the vibrating device comprises:

a movable support able to support the receptacle loaded with folding boxes, the support having a contact surface designed to be in contact with the receptacle, and at least one controllable actuator comprising a displaceable end connected to the support and able to displace the support between:

a retracted position in which the contact surface is positioned beneath the horizontal transport plane, allowing a contact between the receptacle and the driving elements, and a deployed position in which the contact surface is positioned above the horizontal transport plane, preventing the contact between the receptacle and the driving elements, the at least one controllable actuator being likewise designed to cause the support to vibrate about the deployed position in order to reorder the disposition of the folding boxes contained in the receptacle, wherein the support comprises at least two support elements, each having a blade and a support plate, wherein one or more of a front edge or a rear edge of the blade is inclined downward.

2. The vibrating device of claim 1, comprising a control unit connected to the at least one controllable actuator, the control unit being designed to control the travel of the at least one controllable actuator between the retracted position and the deployed position and to cause the support to vibrate in the deployed position.

3. The vibrating device of claim 2, wherein the control unit is designed to be connected to the driving elements of the evacuation conveyor, to control the stopping of the driving elements prior to control the displacement of the support into the deployed position, and to control the restarting of the driving elements after the displacement of the support into the retracted position.

4. The vibrating device of claim 2, wherein the at least one controllable actuator includes at least two actuators connected to the support and arranged at a spacing from each other, the control unit being designed to control the at least two actuators sequentially in a predetermined operating sequence.

5. The vibrating device of claim 1, the support plate being secured perpendicular to the blade, the blades being disposed in parallel in the same plane, the at least two support elements being situated between two driving elements of the evacuation conveyor.

6. The vibrating device of claim 1, comprising at least one shock absorber situated between the at least one controllable actuator and the support.

7. The vibrating device of claim 1, in which the at least one controllable actuator comprises a jack.

8. The vibrating device of claim 1, wherein both the front edge and the rear edge of the blade are inclined downward.

9. An evacuation conveyor for the evacuation of receptacles loaded with folding boxes, comprising a vibrating device as claimed in claim 1.

10. The evacuation conveyor of claim 9, comprising:

a positioning sensor designed to detect a positioning of a receptacle on the support, a movable end stop, controllable by the positioning sensor, able to be displaced between a retracted position and a blocking position.

11. The evacuation conveyor of claim 10, wherein the driving elements comprise drive rollers.

12. A conveyor of receptacles, comprising a routing conveyor to direct empty receptacles toward a filling zone of the conveyor, comprising an evacuation conveyor for the evacuation of receptacles loaded with folding boxes as claimed in claim 10.

13. A filling station, comprising a conveyor of receptacles as claimed in claim 12.

14. A vibrating device and driving elements of an evacuation conveyor, the vibrating device and driving elements comprising:

the driving elements to transport a receptacle along the evacuation conveyor and whose vertices define a horizontal transport plane; and the vibrating device for the ordered rearrangement of folding boxes in the receptacle for the evacuation conveyor, wherein the vibrating device comprises:

a movable support able to support the receptacle loaded with folding boxes, the support having a contact surface designed to be in contact with the receptacle, and at least one controllable actuator comprising a displaceable end connected to the support and able to displace the support between:

a retracted position in which the contact surface is positioned beneath the horizontal transport plane, allowing a contact between the receptacle and the driving elements, and a deployed position in which the contact surface is positioned above the horizontal transport plane, preventing the contact between the receptacle and the driving elements, the at least one controllable actuator being likewise designed to cause the support to vibrate about the deployed position in order to reorder the disposition of the folding boxes contained in the receptacle, wherein the driving elements remain in the horizontal transport plane while the receptacle is transported by the driving elements, while the support is in the retracted position, and while the support is in the deployed position; and an end stop to block the receptacle on the evacuation conveyor above the vibrating device, wherein the end stop is configured for the evacuation conveyor to transport other receptacles during an operation of the vibrating device.

15. The vibrating device and driving elements of claim 14, wherein the driving elements are drive rollers extending transverse to a direction of travel of the receptacle on the evacuation conveyor.

16. The vibrating device and driving elements of claim 14, wherein the driving elements are drive belts extending in line with a direction of travel of the receptacle on the evacuation conveyor.

17. The vibrating device and driving elements of claim 14, wherein the driving elements are provided both upstream and downstream of the vibrating device in a direction of travel of the receptacle on the evacuation conveyor.

18. The vibrating device and driving elements of claim 14, wherein the evacuation conveyor is configured to receive the receptacle including the folding boxes at an entrance of the evacuation conveyor.

* * * * *